United States Patent [19]

Chi-Hung

[11] Patent Number: 4,807,554

[45] Date of Patent: Feb. 28, 1989

[54] INFLATABLE BOAT FOR HIGH SPEED APPLICATIONS

[75] Inventor: Tseng Chi-Hung, Taipei, Taiwan

[73] Assignee: Intex Recreation Corp., Long Beach, Calif.

[21] Appl. No.: 20,031

[22] Filed: Feb. 27, 1987

[51] Int. Cl.[4] ..... B63B 7/08

[52] U.S. Cl. ..... 114/345; 114/253; 441/66

[58] Field of Search ..... 114/218, 253, 254, 345; 441/65, 66; 24/129 R, 115 R; 410/96, 97, 101

[56] References Cited

U.S. PATENT DOCUMENTS

| | | | |
|---|---|---|---|
| 486,597 | 11/1892 | Gamble et al. | 114/345 |
| 2,408,789 | 10/1946 | Luisada | 114/345 |
| 3,174,780 | 3/1965 | Shapiro | 24/129 X |
| 3,380,425 | 4/1968 | Wilson | 114/253 |

FOREIGN PATENT DOCUMENTS

| | | | |
|---|---|---|---|
| 423214 | 12/1925 | Fed. Rep. of Germany | 114/345 |
| 1582802 | 10/1969 | France | 114/345 |
| 393959 | 11/1965 | Switzerland | 441/66 |

*Primary Examiner*—Sherman D. Basinger

*Attorney, Agent, or Firm*—Fulwider, Patton, Rieber, Lee & Utecht

[57] ABSTRACT

An inflatable boat for high speed towing applications having a compartmentalized hull and an improved tow-ring mounted beneath the hull, the hull including first and second buoyancy chambers, the second chamber being vertically disposed beneath the first chamber. Inclined, flexible reinforcing partitions are substantially vertically disposed within the second buoyancy chamber to substantially divide the chamber into a plurality of sub-chambers, and restrain the bottom wall of the chamber upon inflation, to form outwardly projecting convex arcuate portions having longitudinal grooves defined therebetween. The tow-ring includes a reinforced hollow structure having interior reinforcing walls and a convexly curved top wall, portions of the walls together defining a peripherally disposed pair of longitudinal tie-line tunnels and a transverse tie-line tunnel, sized to receive a tie-line therethrough.

5 Claims, 3 Drawing Sheets

INFLATABLE BOAT FOR HIGH SPEED APPLICATIONS

BACKGROUND OF THE INVENTION

This invention relates generally to improvements in inflatable boats and, more particularly, to a new and improved compartmentalized inflatable boat adapted for high speed applications.

People have long been fascinated by water and have constantly given thought to conquering and controlling it. Initially, hollow weeds or logs were bound together to enable the fording of rivers and the crossing of lakes. Eventually, inflatable boats incorporating air filled chambers formed of elastomeric or canvas materials were introduced for use as floatation devices. These inflatable boats have the advantages of increased mobility, because they can be deflated and stored in a relatively compact space, and economy, because of their lower production costs.

However, despite the aforedescribed advantages, these devices are generally not well suited for high speed aquatic usage. For purposes of illustration, high speed applications may be defined as including, but not limited to, speeds from about seven nautical miles per hour ("knots") to about thirty knots.

Because of their particular construction, i.e., a buoyancy chamber or a plurality of connected horizontally adjacent chambers defined by an elastomeric, canvas, or otherwise flexible material, inflatable boats do not generally have the fixed shape and structural integrity of conventional wood, fiberglass or metal formed boat hulls. As a result, inflatable boats may not be able to support the machinery necessary to move the boat at high speeds through the water. For this reason, to achieve high speeds, inflatable boats are generally towed behind another conveyance, i.e., a towing vehicle. However, when one side of the inflatable boat is subjected to a strong force, such as that exerted by a towing vehicle, there is an inclination of the air-filled hull. Concurrent with this inclination is a movement of the interior air mass within each chamber to the highest possible point, adversely affecting the shape and load carrying ability of the inflatable boat. Conventionally, a plurality of separate buoyancy chambers may be used to reduce this intra-buoyancy chamber airflow. Typically, however, the chambers may flex or pivot relative to each other, reducing the horizontal rigidity of the inflatable boat and increasing the drag of the boat within the water. As a result, conventional inflatable boats have not completely resolved the need to minimize intrabuoyancy chamber air flow while maintaining the horizontal rigidity of the inflatable boat hull.

Moreover, conventional boats attempt to minimize the magnitude of the force upon the towed inflatable boat by the use of conventional towing structures. Generally, this force is distributed by incorporating a plurality of towing seats or rings disposed peripherally upon the upper surface of the boat. A rope is passed through these tow seats and connected to a second tow-line extending from the tow vehicle. However, by this construction, the pulling on the latter tow-line affects portions of the inflatable boat differently, i.e., at each tow seat, distorting the inflatable boat in a multitude of directions. These multi-directional distortions contribute to the stresses applied to the inflatable boat and reduce the ability of the boat to follow the towing vehicle.

Skin frictional resistance is the drag of water upon the surface of the boat's hull, and it is generally the largest factor in the total resistance of the boat hull as it moves through the water. The skin friction of inflatable boats may be compounded by the effect of surface waves upon the boat's hull. Inflatable boats, because of their use of buoyancy chambers, generally ride higher in the water, i.e., have a minimum draft, and are more susceptible to wave action and drag.

Furthermore, as a result of conventional manufacturing methods, three-face welds, bonds or seams are typically incorporated into the construction of an air-filled boat. These welds or bonds are usually performed by high-frequency or resistance welding or bonding. However, because of the aforedescribed stresses and distortions, ruptures may occur at such welding seams.

As a result, there has been a significant, long existing need for an inflatable boat having a hull adaptable for high speed towing applications wherein the hull maintains horizontal rigidity, minimizes intrabuoyancy chamber air flow, avoids the use of three-face welding seams, and otherwise minimizes the drag or stress effects of high speed use. In addition, there has been a significant, long existing need for an inflatable boat having an improved towing seat or ring to distribute and diffuse the stresses exerted upon the boat by the towing vehicle. The present invention satisfies all of these needs.

SUMMARY OF THE INVENTION

In accordance with the present invention, an inflatable boat construction is provided which minimizes the distortion of the boat and decreases the resistance of the boat to movement through the water. Briefly, and in general terms, the invention provides an improved hull structure and tow-ring which adapt the inflatable boat for high speed aquatic use.

By way of example, and not necessarily by way of limitation, the inflatable boat of the present invention includes a compartmentalized hull, having a first buoyancy chamber or inflation compartment and a second buoyancy chamber, the second buoyancy chamber being disposed beneath the first buoyancy chamber. Reinforcing partitions disposed within the second buoyancy chamber substantially divide the second chamber into a central sub-chamber and a pair of sponsons or flanking sub-chambers to provide horizontal rigidity to the second buoyancy chamber, reduce intra-buoyancy chamber air flow, and contour the bottom surface of the second buoyancy chamber. An improved tow-ring is mounted upon a bottom wall of the second buoyancy chamber to distribute the force transmitted from the tow-line to the towed inflatable boat without sacrificing the ability of the inflatable boat to follow the towing vehicle.

In a presently preferred embodiment of the invention, the inflatable boat includes reinforcing partitions disposed substantially vertically within the second buoyancy chamber. More specifically, the reinforcing partitions extend longitudinally substantially the entire length of the second buoyancy chamber. A top edge of each reinforcing partition is joined to an inside surface of a top wall portion of the second buoyancy chamber. A bottom edge of each reinforcing partition is joined to an inside surface of a bottom wall portion of the second buoyancy chamber, laterally inward relative the top edge, towards the central longitudinal axis of the inflatable boat. As a result, the reinforcing partitions are inclined laterally inward, defining a generally V-shaped configuration when viewing the interior of the inflatable boat in vertical cross-section.

Upon inflation of the second buoyancy chamber, these reinforcing partitions are of sufficient height to maintain the horizontal rigidity of the bottom buoyancy chamber by inhibiting the flexing the sub-chamber portions relative to each other and to restrain the outward expansion of the bottom wall relative the top wall, to create a bottom surface contour defining longitudinal grooves between adjacent outwardly projecting convex arcuate portions.

In accordance with the presently preferred embodiment of the invention, a hollow reinforced tow-ring having peripherally disposed tie-line tunnels is mounted to a front portion of the second buoyancy chamber bottom wall to diffuse the stress exerted by the towing vehicle upon the inflatable boat. As a result, the tow-ring minimizes the boat's distortion and facilitates its ability to follow the towing vehicle. More specifically, the tow-ring has a generally planar linking seat portion which includes opposite arcuate sides tapering rearward from a first apex at a first or narrower end to a second apex at a second or wider end. The linking seat portion also includes a surface for mounting to the second buoyancy chamber bottom wall. A base plate portion extends inward from the linking seat portion to an outwardly projecting, convexly curved top wall. The top wall includes an apical ridge extending longitudinally, from the first tow-ring end to the second tow-ring end, and outwardly, relative the plane of the base plate portion.

Within the interior of the convexly curved top wall is a plurality of reinforcing walls extending downward from the top wall to the plane of the base plate. Portions of these reinforcing walls and the convexly curved top wall define the tie-line tunnels, these tunnels sized to receive tie-line therethrough. In the preferred form, a pair of longitudinal tie-line tunnels and a transverse tie-line tunnel are substantially peripherally disposed about the circumference of the base plate portion to receive the tie-line.

Other features and advantages of the present invention will become more apparent from the following more detailed description, taken in conjunction with the accompanying drawings, which illustrate, by way of example, the principles of the invention.

DETAILED DESCRIPTION OF THE INVENTION

Figure 2:
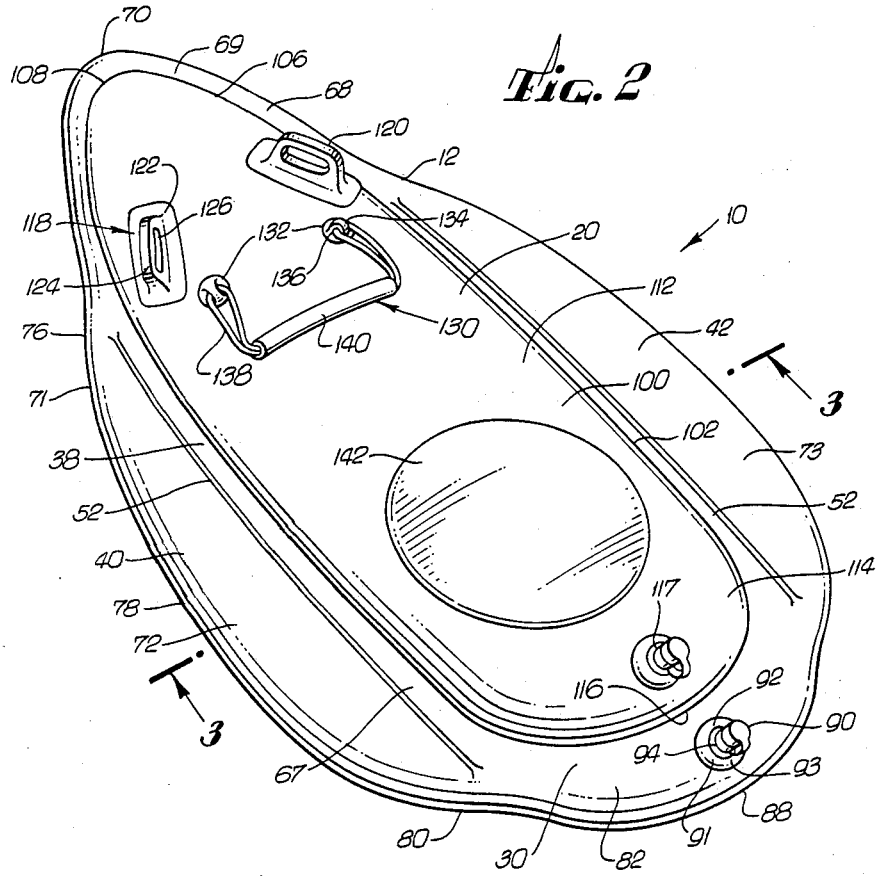
FIG. 2 is a top perspective view of an inflatable boat constructed in accordance with the present invention.
Figure 3:
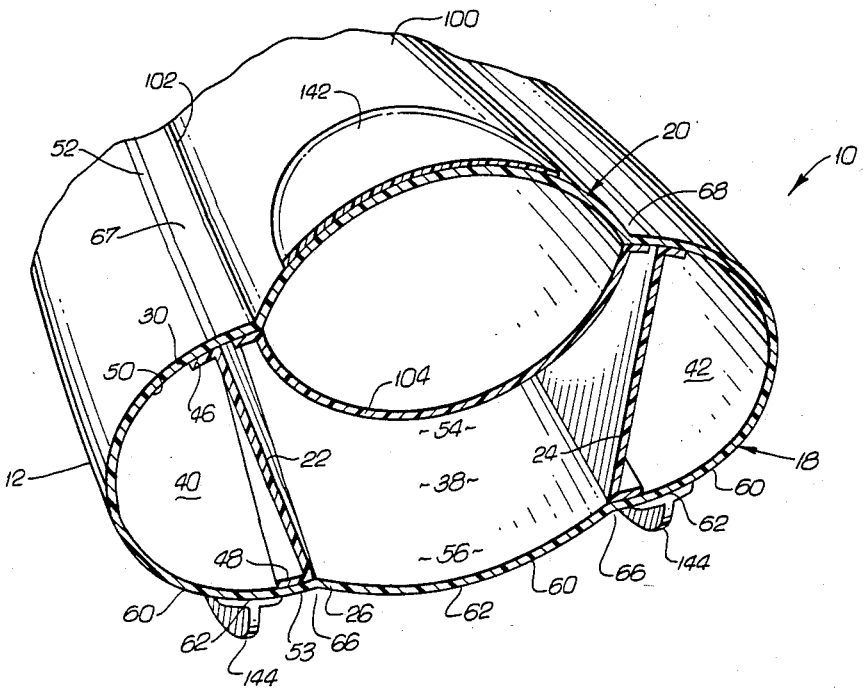
FIG. 3 is a fragmentary, transverse sectional view of the inflatable boat of FIG. 2, taken substantially along the line 3—3.
Figure 4:
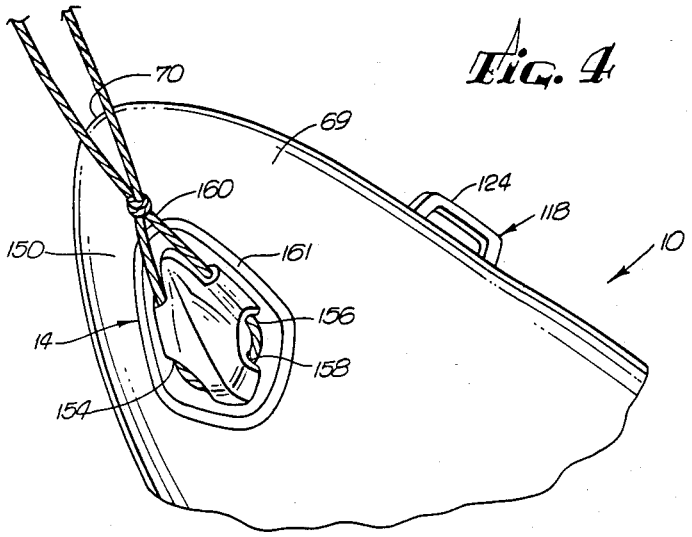
FIG. 4 is a fragmentary, bottom perspective view of the front end of the inflatable boat of the present invention depicting the improved tow-ring of the present invention.
Figure 5:
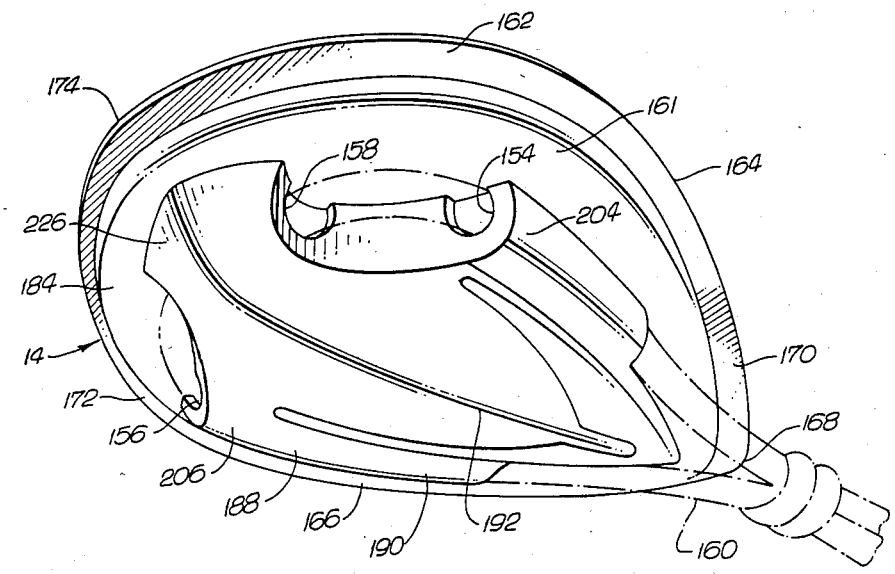
FIG. 5 is an enlarged perspective view of the exposed exterior of the improved tow-ring of the present invention.
Figure 6:
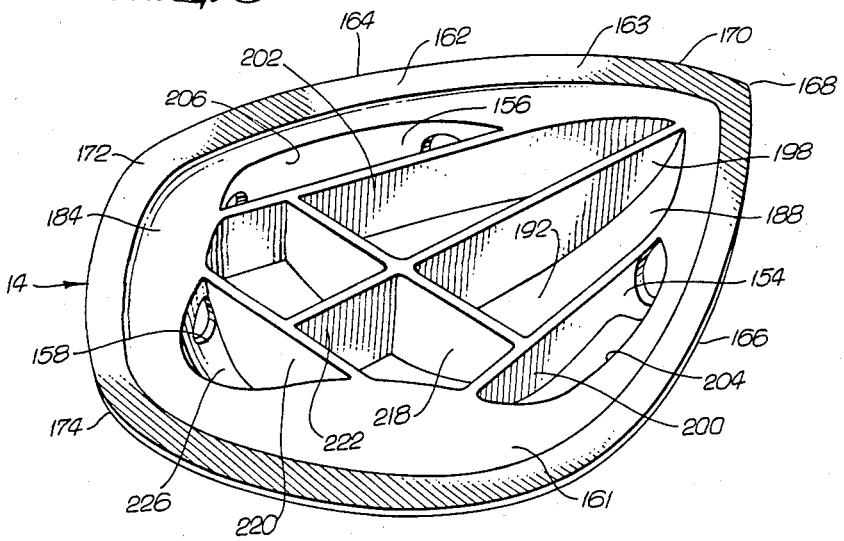
FIG. 6 is an enlarged, top perspective view of the interior of the improved tow-ring of the present invention.

As shown in FIGS. 2 through 4 of the drawings, for purposes of illustration, an inflatable boat, referred to generally by the reference numeral 10, is provided for towing at high speeds while retaining structural rigidity and reducing drag in the water. More specifically, as shown in FIGS. 2 and 3, the present invention generally includes a hull 12 and, as shown in FIGS. 4 through 6, a tow-ring 14 disposed on a lower portion of the hull. The hull includes a bottom buoyancy chamber 18 disposed beneath a top buoyancy chamber 20. As shown in FIG. 3, disposed within the bottom or second buoyancy chamber are a pair of reinforcing partitions 22 and 24, respectively, to reduce intra-buoyancy chamber air flow without sacrificing the horizontal rigidity of the hull. These reinforcing partitions additionally restrain the outward expansion of the second buoyancy chamber bottom wall 26 relative to the top wall 30 to contour the bottom surface of the inflatable boat and thus reduce the resistance of the boat to movement through water.

The interior of the inflatable boat 10 is shown in more detail in FIG. 3. More particularly, the bottom or second buoyancy chamber 18 includes a pair of reinforcing partitions 22 and 24 substantially vertically disposed therein. In the presently preferred embodiment, the second buoyancy chamber interior is divided into a plurality of sub-chambers, e.g., a central sub-chamber or portion 38, flanked by first and second sponsons or lateral sub-chambers 40 and 42, respectively. These reinforcing partitions are generally rectangular members of an elastomeric material. For example, as shown in FIG. 3, the partition 22 has a first or top longitudinal edge or portion 46 and a second or bottom longitudinal edge or portion 48. The top edge 46 of the reinforcing partition is joined, e.g., by fusing, welding or sealing, to an inside surface 50 of the top wall portion 30 of the second buoyancy chamber to form a partition top edge seam 52.

With continued reference to FIG. 3, the reinforcing partition 22 extends downward relative the top wall portion 30 of the second buoyancy chamber and is inclined laterally inward relative the first longitudinal edge 46 or top edge seams 52, towards the central longitudinal axis, to join the bottom wall portion 26 of the second buoyancy chamber and form a partition bottom edge seam 53. The joining of the second reinforcing partition 24 is the mirror image of the partition 22. The first and second reinforcing partitions, together with outer wall portions of the second buoyancy chamber, as described later, define the central sub-chamber 38 as having a wider top portion 54 tapering downwards relative the top wall 30 to a narrower portion 56 proximate the bottom wall 26 of the second buoyancy chamber, i.e., a substantially "V-shaped" configuration when viewing the interior of the chamber in vertical cross-section.

In addition, the long transverse or height dimension of the reinforcing partitions is shorter than a cord connecting two points on a circle having a circumference equal to the outside surface dimension of the second buoyancy chamber. For the purposes of illustration and not limitation, the height of the partitions may be from about seven inches to about ten inches. As a result, the central and each lateral sub-chamber share a substantially vertical dividing wall, i.e., the partitions. This amount of shared vertical dividing wall between the sub-chambers inhibits the pivoting or flexibility of the bottom chamber where the central and lateral sub-chambers join together, i.e., about the planes defined by the partition seams.

As best observed from the partition seam 52 shown in FIG. 2, the reinforcing partitions 22 and 24 run longitudinally, substantially the entire length of the second buoyancy chamber to greatly reduce but still permit some intra-buoyancy chamber air flow adjacent opposite vertical partition ends. By way of example, if the length of the chamber's interior to be separated is about forty inches along the longitudinal axis of the boat 10, the partitions may be about thirty-four or thirty-five inches in length. As a result, these partitions substantially divide the interior of the chamber into the plurality of sub-chambers as earlier described. Because of the support and buffering provided by the reinforcing partitions 22 and 24, the individual sub-chambers are substantially pneumatically independent from each other, i.e., they reduce intra-buoyancy chamber air flow, and yet maintain the horizontal rigidity of the second buoyancy chamber by increasing the shared wall area between adjacent sub-chambers. As a result, the intra-chamber air flow or movement within the buoyancy chambers, as in conventional inflatable boats, is reduced without sacrificing the transverse or horizontal rigidity of the inflatable boat.

Figure 1:
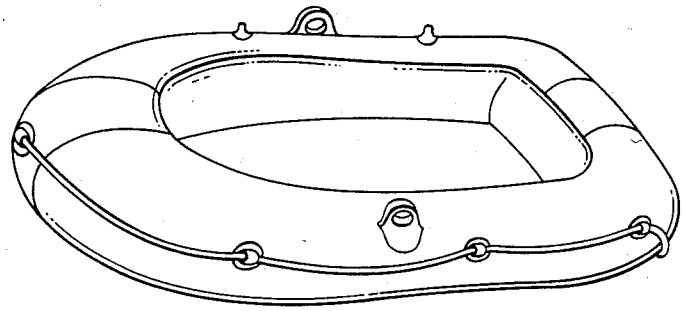
FIG. 1 PRIOR ART
FIG. 1 is a perspective view of a prior art inflatable boat having peripherally mounted tow-rings.

Furthermore, the reinforcing partitions restrain the outward expansion of the bottom wall portion 26 relative to the top wall portion 30, to define, upon inflation of the bottom or second buoyancy chamber, a bottom surface contour having three adjacent and substantially parallel outwardly projecting convex arcuate portions 60. Each arcuate portion 60 has an apex 62 lying in a substantially horizontal plane. Defined between these adjacent arcuate portions are longitudinal grooves 66. As a result, the frictional resistance to the bottom surface to the water is reduced by the reduction of the surface area in contact with the water's surface and the channeling of the water past the boat through the longitudinal grooves. More particularly, the arcuate downward facing surfaces 60 engage the water, as opposed to a planar or flat surface running the entire length and width of the bottom of the inflatable boat as in conventional inflatable boats, as shown in FIG. 1. As a result, the point of contact with the water surface with the bottom of the boat is reduced to three lines at the apex 62 of each arcuate surface. This minimizes the kinetic energy transmitted rom the water, e.g., wave action, to the boat. In addition, the drag impinged upon the inflatable boat of the present invention is reduced. As a result, higher speed applications and an increased stability, as compared to many prior art inflatable boats, is possible.

Referring now to FIG. 2, the exterior shape of the bottom or second buoyancy chamber 18 is streamlined to additionally reduce the drag of the inflatable boat 10 as it's towed through water. More specifically, central outer wall portions 67 and 68 of the top wall 30, as shown in FIG. 2, together with the partitions 22 and 24 and the bottom wall 30 as shown in FIG. 3 and as earlier described, define the central sub-chamber 38. These central outer wall portions include a second buoyancy chamber nose or front portion 69, extending from a second buoyancy chamber front apex 70, and tapering rearward towards a central or mid-portion 71 of the second buoyancy chamber.

With continued reference to FIG. 2, the exterior shape of second buoyancy chamber mid-portion 71 includes sponson outer wall portions 72 and 73 to define, together with the partitions 22 and 24, the sponsons or lateral sub-chambers 40 and 42. These sponson outer wall portions extend outward laterally and substantially oppositely relative the central sub-chamber 38. The sponson outer wall portions 72 and 73 include a generally delta-winged shaped structure analogous to the swept-back wings attached to a central fuselage of an airplane. More specifically, the outer wall portions of the sponsons have a leading edge 76 extending outward from the second buoyancy chamber front portion at an oblique angle of about 25 to about 35 degrees relative the central longitudinal axis of the second buoyancy chamber. Integral with this leading edge portion is a slightly arcuate central or mid-portion edge 78 extending distally from the leading edge and substantially parallel to the central longitudinal axis. Integral with and extending distally relative to the sponson mid-portion edge is a trailing edge portion 80. The trailing edge portion extends inward relative the mid-portion edge towards the central longitudinal axis of the second buoyancy chamber at an oblique angle, at about 45 degrees to about 65 degrees relative the central longitudinal axis. The sponsons are integral with and are connected to a terminating end portion 82 of the central sub-chamber, including a bottom buoyancy chamber second or rear apex 88.

As shown in FIG. 2, in order to inflate the second buoyancy chamber 18, a first one-way valve assembly 90 communicates the interior of the chamber with the outside environment. The bottom buoyancy chamber top wall 26 includes a bubble or flexible dome 91 integral with and extending upward relative to the top wall. The bubble has an aperture 92 at a bubble apex 93. A valve body 94 is received into the aperture 92 to selectively restrict the outward flow of air or gas from the buoyancy chamber. The valve body may be threadingly engaged to the bubble portion to rapidly deflate the chamber by disengagement of the valve body from the wall, e.g., a "Boston-type" valve. The bubble or dome, being flexible, enables the selective placement of the valve structure above or below the surface of the top wall 30, alternatively enabling easy access to a projecting valve assembly for inflation or deflation and its retraction to reduce injury to the operator and/or the valve assembly when sealed.

As best observed in FIGS. 2 and 3, the hull 12 includes a first or upper buoyancy chamber or inflation compartment 20, disposed above the second buoyancy chamber 18. The first buoyancy chamber or inflation compartment is defined by a top wall 100 peripherally joined along a first buoyancy chamber seam 102 to a horizontal bottom or central dividing wall 104. In the presently preferred form, the bottom and top buoyancy chambers 18 and 20, respectively, share the bottom or common dividing wall 104 of the first buoyancy chamber, i.e., the same wall portion that forms a section of the bottom wall of the top buoyancy chamber, forms a portion of the top wall of the bottom chamber. Additionally, the first buoyancy chamber seam is disposed inwardly towards the longitudinal axis relative to the partition top edge seam 52. Upon inflation of the first buoyancy chamber, the top wall and the central dividing wall expand outward relative each other to form a generally cylindrical shape.

Referring to FIG. 2, the first buoyancy chamber is shaped to conform with the earlier described exterior of the inflatable boat 10. More specifically, the first buoyancy chamber includes a tapered nose portion 106 extending rearward from a top buoyancy chamber first or front apex 108. Extending remotely from the front apex 108, integral with the tapered nose portion, is a first buoyancy chamber mid-portion 112. The first buoyancy chamber mid-portion extends distally from the tapered nose portion to terminate at an end portion 114 having a first buoyancy chamber rear apex 116. A second one-way valve assembly 117, having analogous valve and wall configurations as with the earlier described first one-way valve assembly 90, is provided to communicate the interior of the first chamber with the exterior. By this construction, when the inflatable boat 10 is viewed from above, the second buoyancy nose portion 70 extends forward relative the first buoyancy chamber apex 108.

As shown in FIG. 2, mounted on the outside surface of the top wall 100 of the first buoyancy chamber, is a plurality of first handholds 118 and 120. In the preferred form, the first handholds include a base portion 122, seam welded or otherwise joined to the top wall at an oblique angle relative to the central longitudinal axis of the first buoyancy chamber. Extending upward from the base portion is a handle portion 124 having a hand-holding bore 126, sized to receive the operator's hand therethrough. The handholds 118 and 120 may be substantially symmetrically mounted relative the central longitudinal axis of the top buoyancy chamber.

As best shown in FIG. 2, mounted adjacent said handholds 118 and 120 may be a second handhold 130. In the preferred form the second handhold includes a pair of tie-cleats 132, mounted upon the first buoyancy chamber top wall 100. Each tie-cleat 132 includes an upstanding member 134 having a bore 136, sized to receive a strap means 138, extending therethrough. The strap means, e.g., a segment of nylon rope, extends between the tie-cleats and is received through a covering 140. The use of the covering increases the operator's ability to grip the strap means surface when it is wet and yet reduce the likelihood of friction burns the operator may receive while grasping the first strap means.

As shown in FIGS. 2 and 3, disposed within the top wall 100 of the first buoyancy chamber is a seat portion 142. The seat portion is located rearward relative the first handholds 118 and 120, towards the second apex 116. For the purposes of illustration and not limitation, the seat portion may be located rearward about two-thirds of way between the first apex 108 and second apex 116. In the preferred form, the seat portion includes a reinforced double-layered and generally circular top wall portion. Generally, the seat may be of a contrasting color with respect to the rest of the top wall's coloration so that an operator can more readily identify the proper location to sit.

As shown in FIG. 3, a plurality of fins 144 may be mounted on the bottom wall 26 of the second buoyancy chamber to enable the inflatable boat to resist lateral motion when it is being towed through the water. Generally these fins may be located below the seat portion, e.g., rearward about two-thirds of the way between the first apex 108 and the second apex 116.

In addition, in the presently preferred form of the invention, the inflatable boat 10, includes a tow-ring 14 to diffuse or distribute the stress or force transmitted from the towing vehicle to the towed inflatable boat while avoiding the multi-directional distortion of conventional towing means. As shown in FIG. 4, the tow-ring 14 is mounted upon a bottom wall portion 150 of the second buoyancy chamber's nose portion 69. As a result, the nose portion is lifted upward when the towing vehicle pulls the inflatable boat 10, reducing its contact with the water's surface. Generally, the tow-ring 14, includes a reinforced hollow structure having a first and second longitudinal tie-line tunnels 154 and 156 and a transverse tie-line tunnel 158, each tunnel sized to receive a tie-line 160 therethrough. The longitudinal and transverse tie-line tunnels are substantially peripherally and circumferentially disposed about the tow-ring 14. Indeed the longitudinal tie-line tunnels may be substantially symmetrically disposed relative a central longitudinal axis of the tow-ring.

With the tow-ring 14 as constructed and positioned in accordance with present invention, the towing forces are distributed or diffused over a greater surface area without multi-directional distortion of the boat, as by the conventional towing structure including a plurality of tow-rings, as shown in FIG. 1. In addition, because the longitudinal tie-line tunnels are substantially symmetrically disposed and the transverse tie-line tunnel is disposed on the rear portion of the towing seat or ring, the tie-line portions passing through the longitudinal tunnels are drawn inward towards the central longitudinal axis of the tow-ring when a towing force is applied to the tie-line. As a result, the inward pull of the tie-line towards the center of the tow-ring within each longitudinal tie-line tunnel tends to cancel out the other, leaving the pull substantially axial along the tow-line being the major force applied to the boat. This results in a uni-directional towing force being applied to the inflatable boat despite its being diffused over a greater surface area than a single tow-ring, without the multi-directional distortion of a plurality of tow-rings as shown in FIG. 1.

As shown in FIGS. 4 through 6, the tow-ring 14 includes a base portion 161 having a tapered periphery. More specifically, as shown in FIGS. 5 and 6 the base portion includes linking seat portion 162 having a surface 163 for mounting to the inflatable boat. In addition the linking seat portion includes opposite arcuate sides 164 and 166. In the presently preferred embodiment of the present invention, the opposite arcuate sides 164 and 166 extend from a first or front tow-ring apex 168 at a narrower first end 170 towards a wider, substantially opposite, second tow-ring end 172, to terminate at a second or rear tow-ring apex 174. For the purposes of illustration and not limitation, the linking seat portion may be about nine inches long at its longest portion and about eight inches across at is widest portion. This widest portion is generally rearward about two-thirds of the way between the first and second tow-ring apices. As shown in FIG. 4, the bottom mounting surface 163 is joined to a bottom wall 150 of the nose portion 69 of the second buoyancy chamber, the narrower first end facing forward, i.e., the first or narrower end placed towards the first apex 70 of the second buoyancy chamber, and the wider end placed toward the second apex 88 of the second buoyancy chamber.

As shown in FIGS. 5 and 6, the tow-ring 14 includes a base portion 184, extending laterally inward from and relative to an inward portion of the linking seat 162, to terminate in an outwardly projecting convexly curved wall portion 188 extending inwardly and projecting outwardly therefrom. The convexly curved wall portion 188 has an outer surface 190, extending outward relative the plane of the base plate portion. The outer surface 190 includes a central apical ridge 192, running longitudinally from adjacent the first tow-ring apex 168 to adjacent the second tow-ring apex 174. The streamlined or tapered exterior form of the tow-ring, together with the apical ridge, reduces the resistance or drag of the tow-ring through the water.

With continued reference to FIG. 6, the tow-ring 14 includes a plurality of interior reinforcing walls, to provide structural integrity and to distribute the stress applied by the towing vehicle throughout the tow-rings entire structure. In addition, these reinforcing walls, together with portions of the convexly curved wall 180, define the respective tie-line tunnels. More particularly, in the presently preferred form of the invention, a first or central longitudinal wall 198 extending inward from and relative to the apical ridge 192, towards the plane of the base plate portion 184. Flanking or second and third longitudinal walls 200 and 202, respectively, extend inward from and relative to the convexly curved wall 188, substantially parallel to the central longitudinal wall 198. The flanking longitudinal walls, together with outer portions 204 and 206 of the convexly curved wall 188, respectively, define the first and second longitudinal tie-line tunnels 154 and 156 substantially peripherally disposed about the periphery of the tow-ring base portion 161. The longitudinal tunnels may be symmetrically disposed relative the central longitudinal axis of the tow-ring 14.

As shown in FIG. 6, a first lateral reinforcing wall 218 extends downward from the convexly curved wall portion 188 towards the plane of the base plate. The first lateral wall extends transversely relative the longitudinal axis of the tow-ring, substantially perpendicular to the central longitudinal wall 198, and may join, on opposite ends, to the flanking support walls 200 and 202.

Referring to FIG. 6, the tow-ring 14 includes, a second lateral reinforcing wall 220. The second lateral reinforcing wall is disposed towards the wider portion 172 of the tow-ring 14 and may be medially joined to an end portion 222 of the central longitudinal wall 198. The second lateral wall extends downward from the convexly curved wall portion 178, towards the plane of the base plate portion. As a result, the second lateral wall, together with the outer portion 226 of the convexly curved wall portion 188, define the transverse tie-line tunnel 158, substantially peripherally disposed upon the tow-ring base portion 161.

In operation, the linking seat bottom mounting surface 163 may be joined to the lower part of the hull by high frequency fusion methods so that it is firmly affixed to the hull 12. The tie-line 160 is passed in series, through the tie-line tunnels 154, 156 and 158, substantially circumventing the convexly curved wall portion 188 to provide a substantially unidirectional towing force as earlier described. Opposite ends of the tie-line 160 may be joined, e.g., by the tying of a knot.

In order to maximize the benefits of the compartmentalized hull 12 of the present invention, it is inflated in the following preferred manner. First, the top or first buoyancy chamber is inflated to about two-thirds full. It is important that the top buoyancy chamber not be fully inflated at this time. Next, the bottom or second buoyancy chamber is inflated until it is firm. Then, the first buoyancy chamber is inflated until it is firm. A tow-line of standard length (not shown) is connected to the tie-line 160 and the operator is allowed to climb aboard the inflatable boat 10. Generally, the operator will remain in a semi-kneeling position, sitting upon the designated seat portion 142, grasping either the first or second handholds. Alternatively, the operator may lie-down upon the inflatable boat. The inflatable boat with its passenger is then towed behind a conventional ski boat or other vehicle.

While the aforedescribed preferred embodiment is addressed specifically to a one-person or single rider embodiment of the inflatable boat 10, other embodiments may accommodate multiple passengers. As a result in such an increase in the carrying load, additional second handholds 130, seat portions 142, and an increased width and length in the buoyancy chamber dimensions are provided. For the purposes of illustration and not limitation, if a single operator embodiment is about five feet long, the two person embodiment may be six and one-half feet long with commensurately increased buoyancy chamber dimensions.

From the foregoing description, it will be appreciated that the present invention provides an improved inflatable boat structure especially adapted for high speed towing. While particular forms of the compartmentalized inflatable boat of the present invention have been illustrated and described in some detail herein, various modifications may be made without departing from the spirit and scope of the present invention. Accordingly it is not intended that the invention be limited except as by the appended following claims.

What is claimed is:

1. An inflatable frame-less boat comprising:

a first buoyancy chamber;

a second buoyancy chamber disposed beneath said first buoyancy chamber, wherein said second buoyancy chamber includes a top wall portion, a bottom wall portion and a central longitudinal axis; and flexible partition means disposed within said second buoyancy chamber, wherein said partition means includes a pair of flexible reinforcing partitions, substantially vertically disposed within said second buoyancy chamber, said pair of flexible reinforcing partitions including first and second longitudinal edges, said first edge being joined to said top wall portion, said second edge being joined to said bottom wall portion to form a bottom edge seam laterally inward towards said central longitudinal axis to define a generally V-shaped configuration in vertical cross-section, said flexible reinforcing partitions defining a central and lateral sub-chambers for providing horizontal rigidity to said second buoyancy chamber and reducing intra-buoyancy chamber air flow, said chambers sharing a substantially vertical dividing wall, and restrain the outward expansion of said bottom wall portion relative said top wall portion to create, upon inflation of said second buoyancy chamber, a second buoyancy chamber bottom surface contour having adjacent outwardly projecting convex arcuate portions defining longitudinal grooves between said adjacent arcuate portions.

2. An inflatable boat tow-ring to distribute, over a surface area, towing forces applied thereto, said tow-ring comprising a member having first and second longitudinal tie-line tunnels and a transverse tie-line tunnel, wherein said member is a reinforced hollow structure including a base portion having a tapered periphery and a convexly curved wall extending inward and projecting outward from said base portion, portions of said convexly curved wall defining said first and second longitudinal tie-line tunnels and said transverse tie-line tunnel, said tunnels substantially peripherally disposed about said base portion for receiving said tie-line therethrough.

3. An inflatable boat tow-ring to distribute, over a surface area, towing forces applied thereto, said tow-ring comprising a member having first and second longitudinal tie-line tunnels and a transverse tie-line tunnel, wherein said member includes a linking seat portion having opposite arcuate sides, extending from a first apex and a narrower first end towards a second apex and a wider second end, and a surface for mounting to said inflatable boat;

a base plate portion extending inwards from said seat portion;

a convexly curved wall portion extending inwardly and projecting outwardly from said base plate portion to an apical ridge extending from adjacent said narrower first end to adjacent said wider second end; and a plurality of reinforcing walls extending downward from said convexly curved wall to the plane of said base plate portion, said walls together with a respective outside portion of said convexly curved wall portion, defining said first and second longitudinal tie-line tunnels and said transverse tie-line tunnel, said tunnels sized to receive said tie-line, whereby said tie-line passes through said tunnels, substantially circumventing said convexly curved wall portion to provide a substantially unidirectional towing force.

4. An inflatable frame-less boat for high speed aquatic travel, comprising:

a first buoyancy chamber;

a second buoyancy chamber having a top and bottom wall portions, said second buoyancy chamber disposed beneath said first buoyancy chamber and sharing a common dividing wall therebetween;

a first and second partitions, said partitions substantially vertically disposed within said second chamber, each said partition having a top longitudinal edge mounted to said top wall and a bottom longitudinal edge mounted to said bottom wall portion of said second buoyancy chamber laterally inward relative said first longitudinal edge, to substantially divide said second chamber into a plurality of sub-chambers, adjacent subchambers sharing a substantially vertical dividing wall inhibiting the pivoting of said sub-chambers relative each other, and restraining the outward expansion of said bottom wall, relative said top wall, creating, upon inflation of said buoyancy chambers, a bottom surface having three substantially parallel, adjacent and longitudinal outwardly projecting convex curved portions, said longitudinal convex curved portions having apices in the same plane and defining a pair of longitudinal grooves.

5. An inflatable boat as set forth in claim 4, further including a tow-ring, said tow-ring having a base portion, for towing said inflatable boat, said base portion mounted on said bottom wall portion.

* * * * *